US009278436B2

(12) United States Patent
Hsieh

(10) Patent No.: US 9,278,436 B2
(45) Date of Patent: Mar. 8, 2016

(54) TORQUE SCREWDRIVER CAPABLE OF ENHANCING TORQUE AND MAINTAIN TORQUE ACCURACY

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 270 days.

(21) Appl. No.: 14/083,798

(22) Filed: Nov. 19, 2013

(65) Prior Publication Data

US 2014/0137710 A1 May 22, 2014

(30) Foreign Application Priority Data

Nov. 19, 2012 (TW) ..... 101222396 U

(51) Int. Cl.
*B25B 23/142* (2006.01)
*B25B 15/04* (2006.01)
*B25B 13/48* (2006.01)

(52) U.S. Cl.
CPC ..... *B25B 15/04* (2013.01); *B25B 13/481* (2013.01); *B25B 23/1427* (2013.01)

(58) Field of Classification Search
CPC .... B25B 15/04; B25B 13/481; B25B 23/1427
USPC ..... 81/473, 475, 477
See application file for complete search history.

(56) References Cited

U.S. PATENT DOCUMENTS

| | | | | |
|---|---|---|---|---|
| 4,346,633 | A * | 8/1982 | Rendl | B25B 23/141 464/43 |
| D356,239 | S * | 3/1995 | Lin | D8/82 |
| 5,643,089 | A * | 7/1997 | Hummel | B25B 23/14 464/37 |
| 7,032,476 | B2 * | 4/2006 | Lin | B25B 15/001 81/473 |
| 7,272,999 | B2 * | 9/2007 | Cutler | B25B 15/02 81/467 |
| 7,331,258 | B1 * | 2/2008 | Hsieh | B25B 13/465 81/58.4 |
| 7,841,261 | B2 * | 11/2010 | Milligan | B25B 13/06 81/121.1 |

* cited by examiner

*Primary Examiner* — Hadi Shakeri
(74) *Attorney, Agent, or Firm* — Guice Patents PLLC

(57) ABSTRACT

A torque screwdriver contains: a main body; a driving head and a torque mechanism disposed in the main body and the driving head engages with the driving head; a grip bar installed on a top end of the main body and having two ends which are a long end and a short end so that a configuration of the grip bar and the main body is in a T shape; an insertion hole defined in a top face of the grip bar, wherein a center of the insertion hole is located at the central axis of the torque mechanism. Thereby, the torque screwdriver is operated in a narrow space easily. A force rod can be inserted into the insertion hole, and a forcing position of the force rod for driving the torque screwdriver is identical to a center of the torque mechanism, thus acquiring a precise torque value.

18 Claims, 6 Drawing Sheets

TORQUE SCREWDRIVER CAPABLE OF ENHANCING TORQUE AND MAINTAIN TORQUE ACCURACY

BACKGROUND OF THE INVENTION

1. Field of the Invention

The present invent relates to a hand tool, and more particularly to a torque screwdriver which is extra provided with a forcing arm.

2. Description of the Related Art

Conventional screwdriver is a hand tool for screwing a screw element. To screw the screw element accurately, a torque screwdriver has been developed so as to set a torque force for screwing the screw element, such that the screw element will not be locked overly or inadequately. Accordingly, such a torque screwdriver is practical for precise equipment.

With reference to FIG. 1, a conventional torque screwdriver 10 contains a body 12 in which a torque mechanism 14 is mounted; and a screwing rod 16 disposed on a bottom end of the body 12 and coupling with the torque mechanism 14, such that when a force exerting on the screwing rod 16 reaches a preset torque, the torque mechanism 14 will slip off so that the screwing rod 16 cannot be rotated. In order to hold and operate the torque screwdriver securely, the body 12 has a grip bar 13 fixed on a top end thereof, and a connection shape of the body 12 and the grip bar 13 forms a T shape handle so as to form a forcing arm of the screwdriver.

Although the T shape handle serves as a forcing arm, the effect of the forcing arm is limited. In the case that a user desires to produce a large torque, the handle is rotated by the user forcefully, but such an operation is against operating requirement to torque mechanism due to the screwdriver is rotated laboriously, inappropriately and rapidly. As for a hand tool with a torque mechanism, a force exerting time to the torque hand tool must be temperate (within 4 to 6 seconds), and a force exerting speed to the torque hand tool must be appropriate. When the force exerting time is too long or too short, or the force exerting speed is inappropriate, the accuracy of the torque mechanism will be affected.

To comply with a precise torque requirement, a force rod 18 is fitted with the grip bar 13 to form a larger forcing arm, thus it is able to screw the screwing element in a large torque and with appropriate force exerting time and force exerting speed.

Nevertheless, such a conventional torque screwdriver has the following disadvantages:

For ergonomic consideration, a peripheral wall of the grip bar 13 is formed with a concave and convex surface, so the force rod 18 cannot fit with the grip bar 13 securely, and is easy to slip from the grip bar. It is thus uneasy to operate, and at the moment when the force rod 18 is slipping from the grip bar 13, the force exerting on the screwdriver changes intensely, thereby causing torque imprecision.

As the force rod 18 rotates the grip bar 13, a forcing position is not located at a center of the torque mechanism 14, i.e., an operation difference generates on the center of the torque mechanism 14, thus causing torque imprecision.

Moreover, the grip bar 13 of the T shape handle cannot be operated smoothly in a limited space.

The present invention has arisen to mitigate and/or obviate the afore-described disadvantages.

SUMMARY OF THE INVENTION

The primary object of the present invention is to provide a torque screwdriver which contains a T-shaped grip bar so that a user forces on the torque screwdriver easily and the torque screwdriver can connect with a forcing arm to enhance torque and to maintain torque accuracy.

Another object of the present invention is to provide a torque screwdriver which contains the T-shaped grip bar to operate the torque screwdriver in a narrow space easily.

The torque screwdriver in accordance with the present invention comprises:

a main body formed in a hollowly elongated shape;

a driving head having a drive segment arranged on a bottom end thereof and disposed in a bottom end of the main body;

a torque mechanism installed in the main body and having a bottom end for detachably engaging with the driving head, and the torque mechanism forcing elasticity onto the driving head; the torque mechanism having a central axis;

a grip bar installed on a top end of the main body and including two ends extending out of the main body, wherein the two ends of the grip bar are a long end and a short end so that a configuration of the grip bar and the main body is in a T shape; an insertion hole defined in a top face of the grip bar, wherein a center of the insertion hole is located at the central axis of the torque mechanism.

Thereby, the torque screwdriver is in the T shape so that the user holds and operates the torque screwdriver easily, and two lengths of the two ends of the grip bar is not equal, so the torque screwdriver is operated in the narrow space conveniently by ways of its short end.

A force rod can be inserted into the torque screwdriver conveniently to force a larger torque and to comply with an operation limitation of the torque mechanism. The forcing position to the force rod for driving the torque screwdriver is identical to the center of the torque mechanism, thus having the precise torque value.

DETAILED DESCRIPTION OF THE PREFERRED EMBODIMENTS

Figure 1:
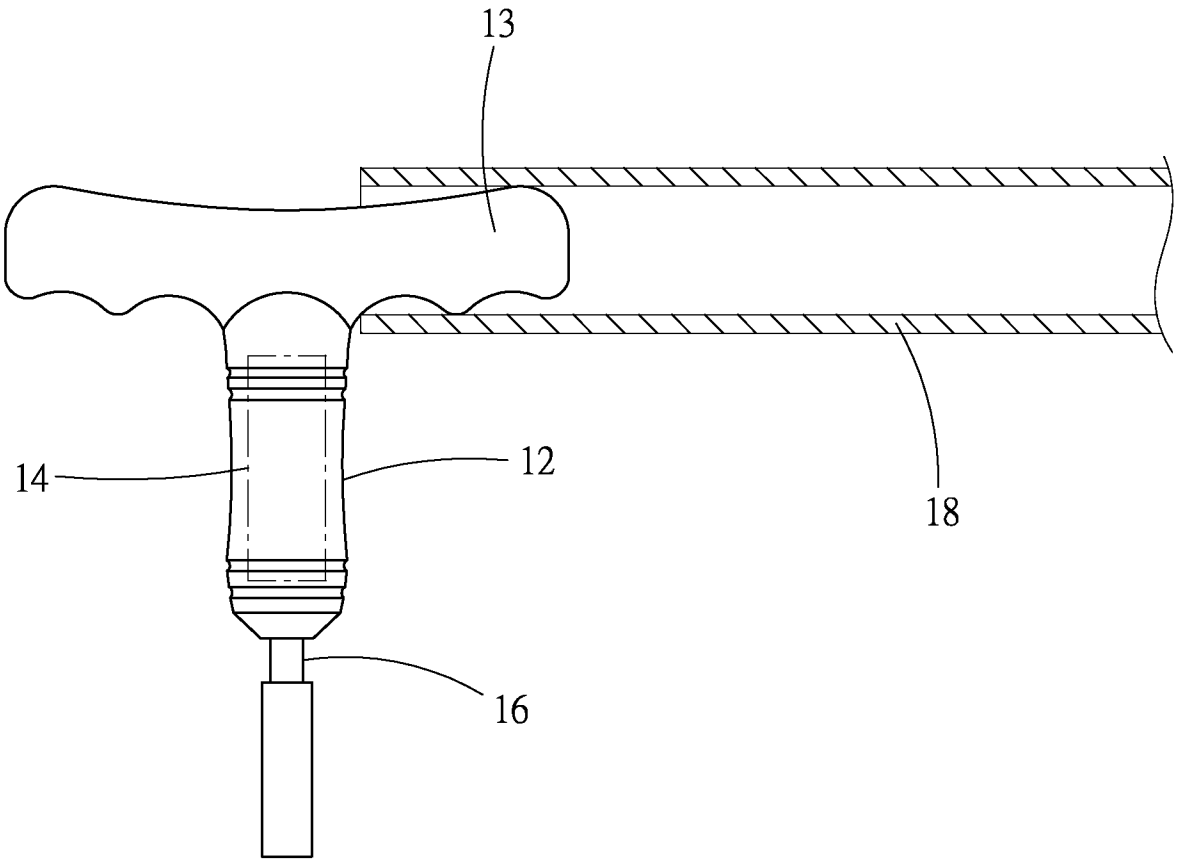
Fig. 1 PRIOR ART
FIG. 1 is a cross sectional view showing the operation of a conventional torque screwdriver.
Figure 2:
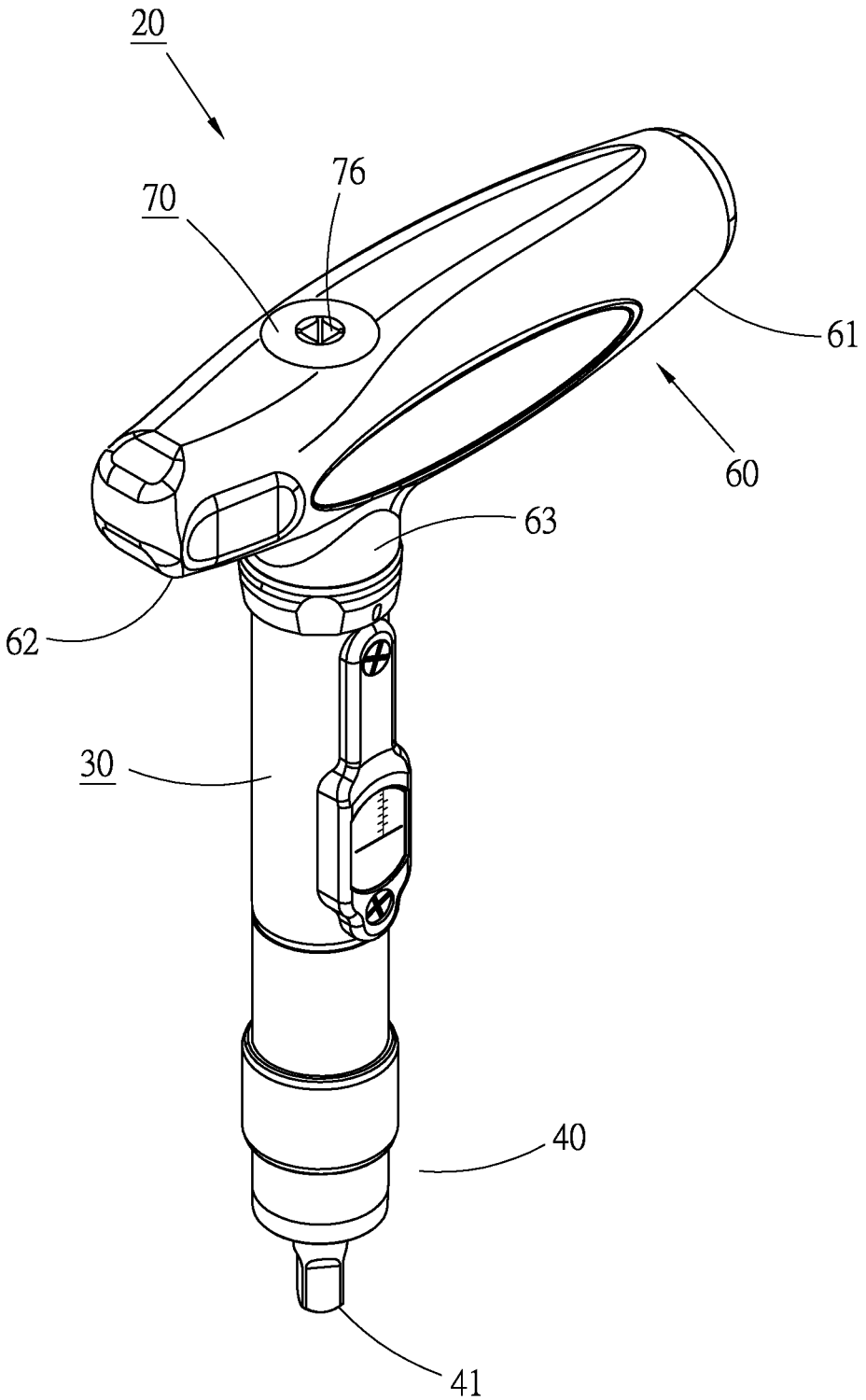
FIG. 2 is a perspective assembled view of a torque screwdriver according to a preferred embodiment of the present invention.
Figure 3:
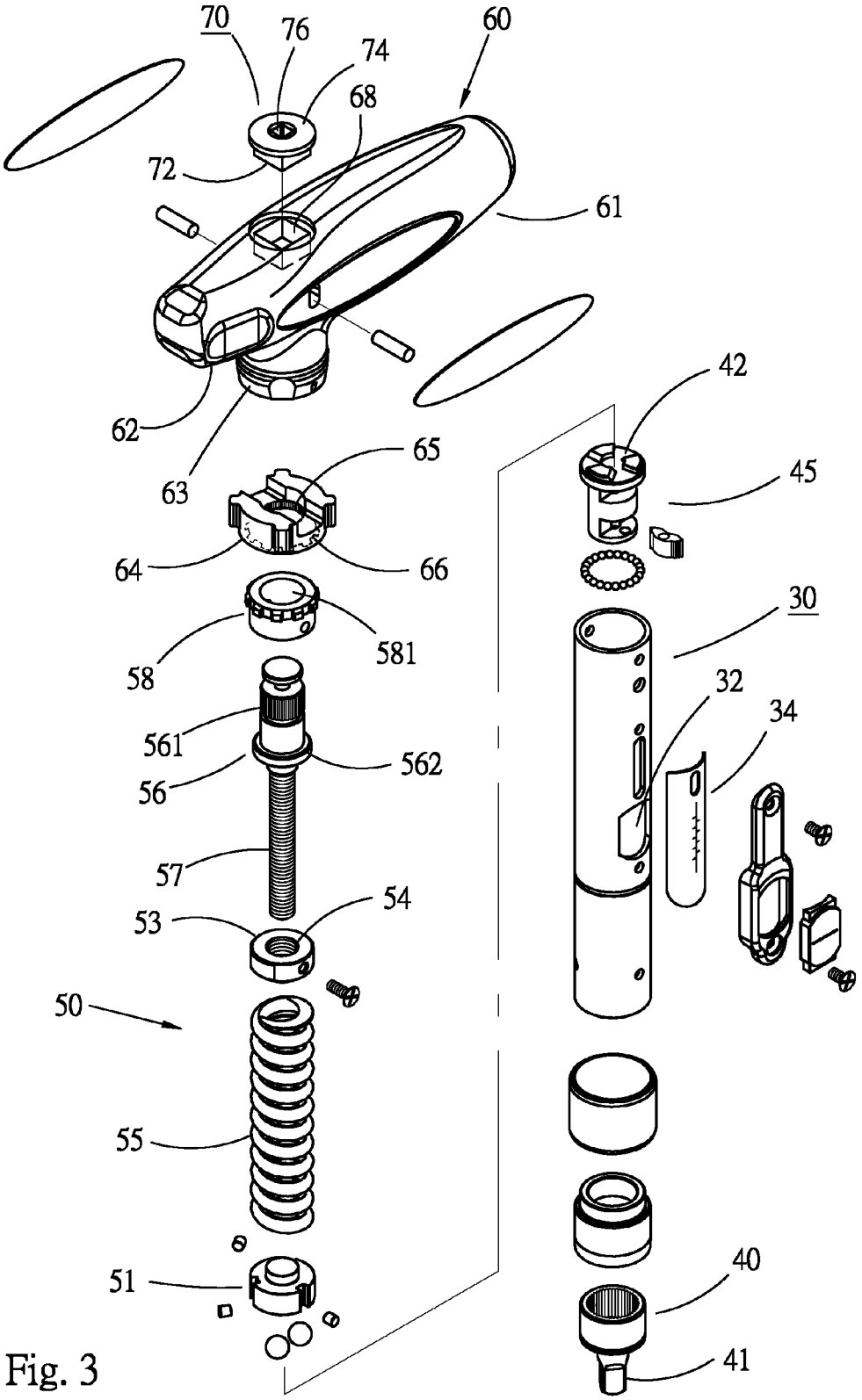
FIG. 3 is a perspective exploded view of the torque screwdriver according to the preferred embodiment of the present invention.
Figure 4:
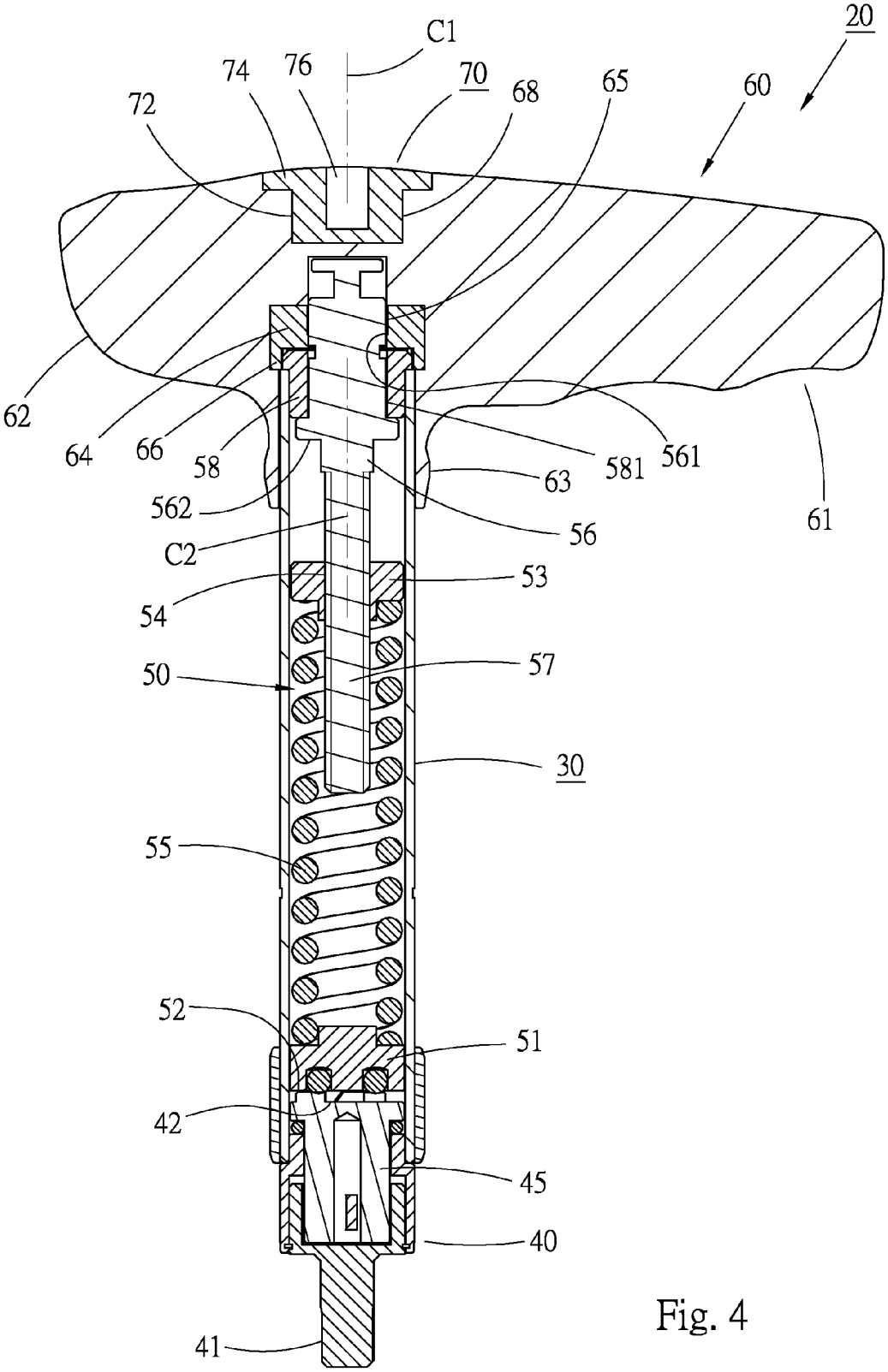
FIG. 4 is a longitudinal cross sectional view of the torque screwdriver according to the preferred embodiment of the present invention.

With reference to FIGS. 2-4, a torque screwdriver 20 according to a preferred embodiment of the present invention comprises: a main body 30, a torque mechanism 50, a grip bar 60, and a connecting member 70.

The main body 30 is a hollow elongated member with two open ends, such as a tube, and is a housing of the torque screwdriver 20 so as to accommodate other components of the torque screwdriver 20 therein.

A driving head 40 is disposed in a bottom end of the main body 30 and includes a drive segment 41 arranged on a bottom end thereof, the drive segment 41 is formed in any one of a flat shape, a cross shape and a star shape so as to drive a screw; or the drive segment 41 is a concave hole for fitting a screwdriver bit. In this embodiment, the drive segment 41 is in a square column shape so as to fit the screwdriver bit by ways of a socket (not shown). A top end of the driving head 40 is inserted into the main body 30 and has a concave and convex (such as a concave and convex portion or teeth) first engaging face 42 defined thereon so as to engage with a bottom end of the torque mechanism 50. The driving head 40 can be a non-ratchet type (i.e., does not has a ratchet structure); in this embodiment, the driving head 40 further includes a ratchet mechanism 45 mounted therein so as to shift a rotating direction, for example, the screwdriver unidirectionally drives the driving head 40 clockwise or counterclockwise; the first engaging face 42 is defined on a top face of the ratchet mechanism 45. The ratchet mechanism can be embodied in various forms of structure, but it is not a main subject of the present invention, further remarks are therefore omitted.

The torque mechanism 50 is installed in the main body 30 and is located above the driving head 40. The torque mechanism 50 may be provided with a fixed torque value which cannot be adjusted. In this embodiment, the torque mechanism 50 has a preset torque value which can be adjusted, and includes a clutch member 51, a sliding element 53, a resilient element 55, an adjustment lever 56, and a positioning seat 58.

The clutch member 51 has a concave and convex (such as a concave and convex portion or teeth) second engaging face 52 defined on a bottom face thereof, as illustrated in FIG. 4, so as to engage with the first engaging face 42 of the driving head 40. The clutch member 51 can only move vertically along the main body 30, and it cannot rotate.

The sliding element 53 moves longitudinally along the main body 30 and does not rotate. A screw hole 54 is defined on a central position of the sliding element 53.

The resilient element 55 is a compression spring and has two ends for abutting against the clutch member 51 and the sliding element 53.

The positioning seat 58 is secured on a top end of the main body 30.

The adjustment lever 56 is inserted into an orifice 581 of the positioning seat 58 and has a threaded segment 57 formed on a lower side thereof so as to screw with the screw hole 54 of the sliding element 53, and the adjustment lever 56 also has a engaging portion 561 defined on an upper end thereof and extending out of the positioning seat 58, the engaging portion 561 has a plurality of tiny teeth surrounding around a peripheral wall thereof. When the adjustment lever 56 is rotated, it drives the sliding element 53 to move so that an elastic force of the resilient element 55 which pushes the clutch member 51 is changed to adjust a torque value. A protruded rib 562 of the adjustment lever 56 retains with the positioning seat 58 so that the adjustment lever 56 is positioned and is prevent from disengagement from the main body 30.

Referring further to FIG. 4, the torque mechanism 50 has a central axis C2; in details, components of the torque mechanism are arranged longitudinally (from the clutch member to the adjustment lever) and provide elasticity which forces onto the driving head 40 along the main body 30 longitudinally, and the central axis C2 is formed on a central line of a longitudinal portion of the torque mechanism 50. The central axis C2 is parallel to a forcing direction of the elasticity of the torque mechanism and is located at a central portion of the adjustment lever 56 in this embodiment. Other details of the torque mechanism are not further described; and various types of torque mechanisms can be applicable for the torque screwdriver of the present invention as well.

The grip bar 60 is installed on the top end of the main body 30 and has two ends extending out of the main body 30 transversely, wherein the two ends of the grip bar 60 are a long end 61 and a short end 62 so that a user holds the grip bar 60 easily. The grip bar 60 is installed on the top end of the main body 30 so as to rotate the torque screwdriver 20. In addition, the grip bar 60 is provided to adjust the torque value of the torque mechanism 50 and the bottom face of the grip bar 60 has a hollow cylinder 63; an engaging member 64 disposed in the hollow cylinder 63. The hollow cylinder 63 of the grip bar 60 is fitted on the top end of the main body 30 and the grip bar 60 can slide longitudinally along the main body 30; the engaging member 64 has a toothed engaging aperture 65 for engaging with the engaging portion 561 of the adjustment lever 56, as illustrated in FIG. 4. The engaging member 64 further has a fitting portion 66 defined on a bottom end thereof, the fitting portion 66 fits with an outer wall of the positioning seat 58, such that the grip bar 60 engages with the top end of the main body 30 so that the grip bar 60 is driven to rotate the main body 30. After moving the grip bar 60 upwardly (not shown), the fitting portion 66 disengages from the positioning seat 58, and the engaging aperture 65 of the engaging member 64 still engages with the engaging portion 561 of the adjustment lever 56, in the meantime, when the grip bar 60 is rotated, the main body 30 will not be rotated, but the adjustment lever 56 is rotated by the grip bar 60, thus adjusting the torque value of the torque mechanism 50. After the adjustment is done, the grip bar 60 is pushed toward the main body 30 so that the fitting portion 66 of the engaging member 64 fits with the positioning seat 58 once more.

The main body 30 further includes a window 32 defined on a peripheral wall thereof; a scale piece 34 mounted in the main body 30 and located at where the window 32 is, the scale piece 34 is connected with the sliding element 53 so as to slide with the sliding element 53, such that the user learns the torque value of the torque mechanism 50 after viewing graduations marked on the scale piece 34.

As desiring to rotate a screw by using the torque screwdriver 20, the grip bar 60 is rotated to swivel the main body 30 and the clutch member 51 of the torque mechanism 50, and the clutch member 51 drives the driving head 40, wherein when a force is more than a set torque value of the torque screwdriver 20, the first engaging face 42 of the driving head 40 slips off the second engaging face 52 of the clutch member 51 so as to remind the user that the force reaches a maximum of the set torque value.

As shown in FIGS. 2-4, the grip bar 60 further includes a recessed portion 68 formed on a top face thereof, the recessed portion 68 has a non-circular cross section, such as a polygonal cross section.

The connecting member 70 includes a block 72 and a disc portion 74 arranged on a top end of the block 72 and having a larger diameter than that of the block 72; an insertion hole 76 defined in a top face of the connecting member 70. The connecting member 70 is installed in the recessed portion 68 of the grip bar 60 by means of the block 72, wherein a cross section of the block 72 corresponds to a profile of the non-circular cross section of the recessed portion 68 so that the connecting member 70 is fixed in the grip bar 60 without rotation. A cross section of the insertion hole 76 is non-circular, such as a polygonal cross section, and a center C1 of the insertion hole 76 is located at the central axis C2 of the torque mechanism 50 as illustrated in FIG. 4.

Figure 5:
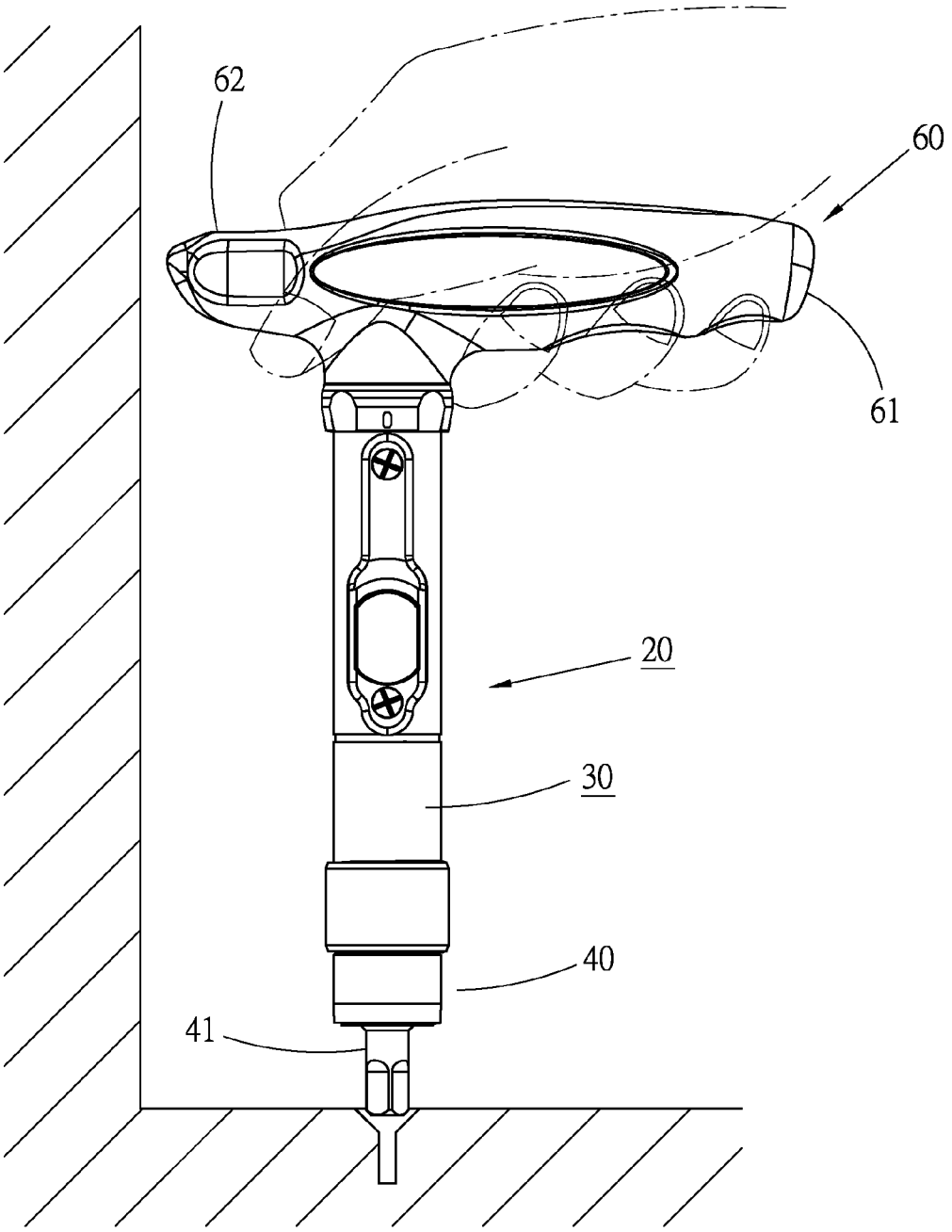
FIG. 5 is a side plan view showing the operation of the torque screwdriver according to the preferred embodiment of the present invention.

A configuration of the grip bar 60 and the main body 30 is in a T shape so that the torque screwdriver is formed with a T shape handle. In use, the user holds the grip bar 60, as shown in FIG. 5, as the grip bar 60 has a configuration defined by a long end 61 and a short end 62, a user can hold the grip bar easily, wherein a palm of the user holds the long end 61 and his/her thumb grips the short end 62, Such grip consists with human factors engineering, and is easy to exert a force on the screwdriver and to operate the torque screwdriver. Preferably, the long end 61 of the grip bar 60 is used as a main forcing arm to rotate torque.

With reference to FIG. 5, due to the short end 62 has a short extending length, it does not interrupt an operation of the torque screwdriver in a narrow space, so that the torque screwdriver is operated suitably in the narrow space.

Figure 6:
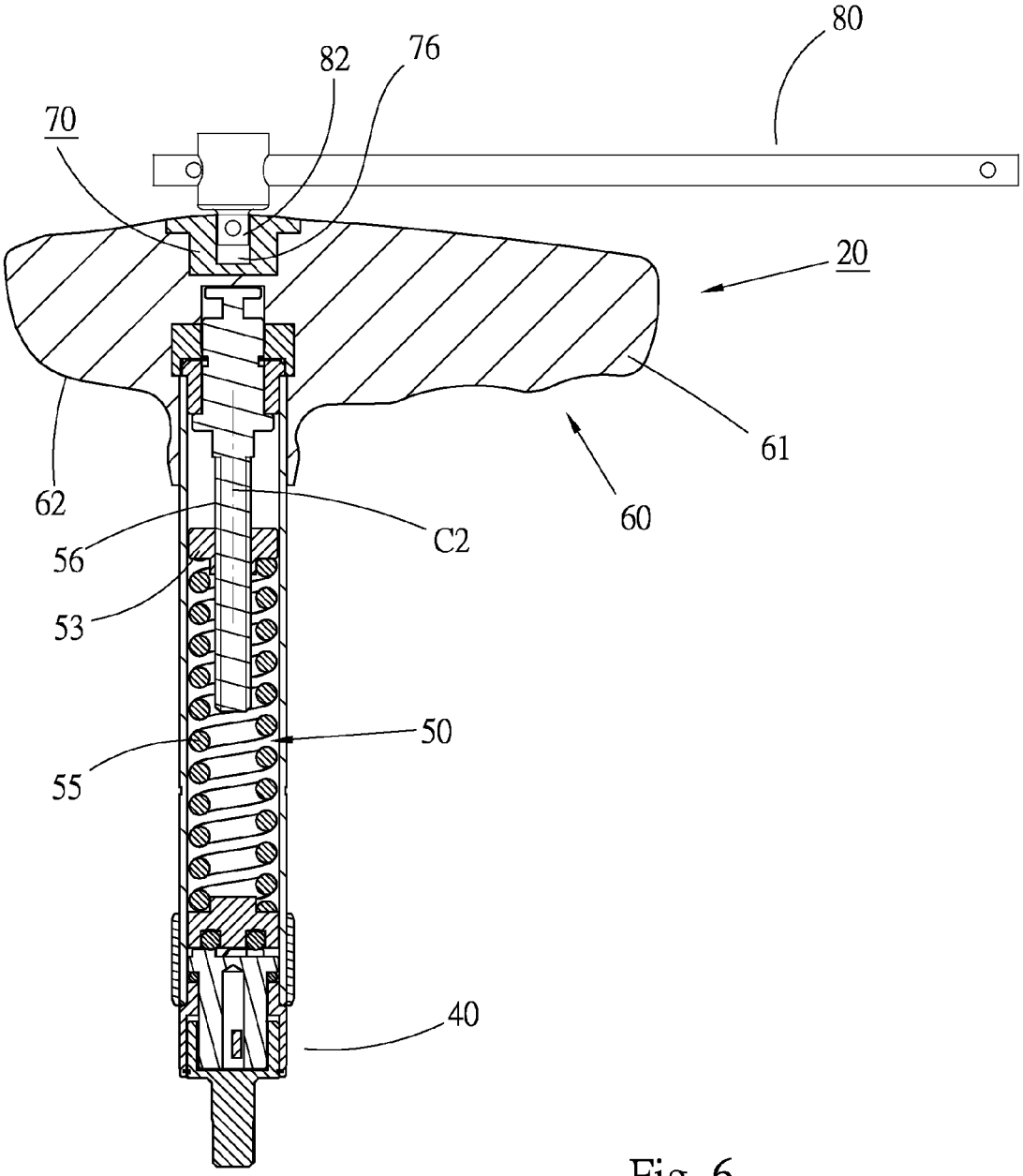
FIG. 6 is a cross sectional view showing the operation of the torque screwdriver according to the preferred embodiment of the present invention.

As intending to rotate the torque screwdriver at a large torque, a forcing arm being extra provided on the torque screwdriver is designed in the invention. As shown in FIG. 6, an inserting column 82 of a force rod 80 is inserted into the insertion hole 76 so that the force rod 80 serves as the forcing arm, hence the large torque is obtained and meanwhile the user can rotate the screwdriver 20 with a suitable operation time and a suitable operation speed to meet the operating requirement to the torque mechanism, and a precise torque value is achieved. The force rod 80 is inserted into the torque screwdriver 20 firmly, there will be no looseness and slip therebetween.

Furthermore, as the insertion position of the inserting column 82 of the force rod 80 is located at the central axis C2 of the torque mechanism 50 exactly, so when the torque screwdriver 20 is operated by ways of the force rod 80, a forcing position is identical to a center of the torque mechanism 50 so as to acquire the precise torque value. After the inserting column 82 is disengaged from the insertion hole 76, the force rod 80 is removed from the torque screwdriver 20 easily.

Thereby, the torque screwdriver of the invention is in the T shape so that the user holds and operates the torque screwdriver easily, and the force rod can be contributed to the torque screwdriver conveniently to provide a larger torque and to comply with an operation limitation of the torque mechanism. In addition, the forcing position to the force rod for driving the torque screwdriver is identical to the center of the torque mechanism, thus having the precise torque value, and the torque value of the torque screwdriver will not be vary or error due to the applied force rod.

While the screwdriver is in T shape, two lengths of the two ends of the grip bar is not equal, so the torque screwdriver is operated in the narrow space conveniently by ways of its short end.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A torque screwdriver capable of enhancing torque and maintain torque accuracy comprising:

a main body formed in a hollowly elongated shape;

a driving head having a drive segment arranged on a bottom end thereof, the driving being disposed in a bottom end of the main body;

a torque mechanism installed in the main body and having a bottom end for engaging with the driving head, and the torque mechanism forcing elasticity onto the driving head; the torque mechanism having a central axis;

a grip bar installed on a top end of the main body and having two ends extending out of the main body, wherein the two ends of the grip bar are a long end and a short end so that a configuration of the grip bar and the main body is in a T shape; an insertion hole defined in a top face of the grip bar, wherein a center of the insertion hole is located at the central axis of the torque mechanism;

wherein a top end of the driving head has a first engaging face defined thereon; the torque mechanism includes a clutch member moving longitudinally along the main body and not rotating, the clutch member has a second engaging face defined on a bottom face thereof so as to engage with the first engaging face of the driving head; a sliding element located above the clutch member and moving longitudinally along the main body; a resilient element having two ends for abutting against the clutch member and the sliding element; an adjustment lever having a bottom end for screwing the sliding element so as to drive the sliding element to move; a top end of the adjustment lever extending out of the main body and connecting with the grip bar.

2. The torque screwdriver as claimed in claim 1, wherein the central axis of the torque mechanism is located at a central portion of the adjustment lever.

3. The torque screwdriver as claimed in claim 2, wherein the grip bar further includes a hollow cylinder defined on the bottom end thereof; an engaging member disposed in the hollow cylinder, and the grip bar is fitted on the top end of the main body by ways of the hollow cylinder; and the engaging member connects with the adjustment lever.

4. The torque screwdriver as claimed in claim 1, wherein the grip bar further includes a hollow cylinder defined on the bottom end thereof; an engaging member disposed in the hollow cylinder, and the grip bar is fitted on the top end of the main body by ways of the hollow cylinder; and the engaging member connects with the adjustment lever.

5. The torque screwdriver as claimed in claim 4, further comprising a positioning seat having an orifice, the positioning seat being mounted on the top end of the main body; the top end of the adjustment lever being inserted into the orifice of the positioning seat; the engaging member further having a fitting portion defined on a bottom end thereof and fitting with an outer wall of the positioning seat.

6. The torque screwdriver as claimed in claim 1, wherein a top end of the driving head has a first engaging face defined thereon; the torque mechanism includes a clutch member and a resilient element, the clutch member moves longitudinally along the main body and does not rotate, and the clutch member has a second engaging face defined on a bottom face thereof so as to engage with the first engaging face of the driving head; the resilient element having one end for abutting against the clutch member so that the clutch member engages with the driving head elastically.

7. The torque screwdriver as claimed in claim 1, further comprising a ratchet mechanism mounted in the driving head and located on the top end of the driving head; the first engaging face of the driving head being defined on a top face of the ratchet mechanism.

8. The torque screwdriver as claimed in claim 1, wherein components of the torque mechanism are arranged longitudinally in the main body, and the central axis is formed on a central line of a longitudinal portion of the torque mechanism.

9. A torque screwdriver capable of enhancing torque and maintain torque accuracy comprising:

a main body formed in a hollowly elongated shape;

a driving head having a drive segment arranged on a bottom end thereof, the driving head being disposed in a bottom end of the main body;

a torque mechanism installed in the main body and providing elasticity, a bottom end of the torque mechanism contacting and engaging with the driving head; the torque mechanism having a central axis;

a grip bar installed on a top end of the main body and having two ends extending out of the main body, wherein the two ends of the grip bar are a long end and a short end so that a configuration of the grip bar and the main body is in a T shape; a recessed portion formed on a top face of the grip bar;

a connecting member including a block; and an insertion hole defined in a top face of the block; the connecting member being installed in the recessed portion of the grip bar; a center of the insertion hole being located at the central axis of the torque mechanism;

wherein a top end of the driving head has a first engaging face defined thereon; the torque mechanism includes a clutch member moving longitudinally along the main body and not rotating, the clutch member has a second engaging face defined on a bottom face thereof so as to engage with the first engaging face of the driving head; a sliding element located above the clutch member and moving longitudinally along the main body; a resilient element having two ends for abutting against the clutch member and the sliding element; an adjustment lever having a bottom end for screwing the sliding element so as to drive the sliding element to move; a top end of the adjustment lever extending out of the main body and connecting with the grip bar.

10. The torque screwdriver as claimed in claim 9, wherein the recessed portion has a non-circular cross section; and a cross section of the block of the connecting member corresponds to a profile of the non-circular cross section of the recessed portion.

11. The torque screwdriver as claimed in claim 10, wherein the block of the connecting member has a disc portion arranged on a top end thereof.

12. The torque screwdriver as claimed in claim 9, wherein the central axis of the torque mechanism is located at a central portion of the adjustment lever.

13. The torque screwdriver as claimed in claim 9, wherein the grip bar further includes a hollow cylinder defined on the bottom end thereof; an engaging member disposed in the hollow cylinder, and the grip bar is fitted on the top end of the main body by ways of the hollow cylinder; and the engaging member connects with the adjustment lever.

14. The torque screwdriver as claimed in claim 9, wherein a top end of the driving head has a first engaging face defined thereon; the torque mechanism includes a clutch member and a resilient element, the clutch member moves longitudinally along the main body and does not rotate, and the clutch member has a second engaging face defined on a bottom face thereof so as to engage with the first engaging face of the driving head; the resilient element having one end for abutting against the clutch member so that the clutch member engages with the driving head elastically.

15. The torque screwdriver as claimed in claim 14, further comprising a ratchet mechanism mounted in the driving head and located on the top end of the driving head; the first engaging face of the driving head being defined on a top face of the ratchet mechanism.

16. The torque screwdriver as claimed in claim 9, further comprising a ratchet mechanism mounted in the driving head.

17. The torque screwdriver as claimed in claim 9, further comprising a ratchet mechanism mounted in the driving head and located on the top end of the driving head; the first engaging face of the driving head being defined on a top face of the ratchet mechanism.

18. The torque screwdriver as claimed in claim 9, wherein components of the torque mechanism are arranged longitudinally in the main body, and the central axis is formed on a central line of a longitudinal portion of the torque mechanism.

* * * * *